US008686937B2

(12) United States Patent
Yoo

(10) Patent No.: US 8,686,937 B2
(45) Date of Patent: Apr. 1, 2014

(54) BACKLIGHT UNIT WITH FEEDBACK CIRCUIT AND DRIVING METHOD USING THE SAME

(75) Inventor: Yeon-Taek Yoo, Cheongju-si (KR)

(73) Assignee: LG Display Co. Ltd., Seoul (KR)

( * ) Notice: Subject to any disclaimer, the term of this patent is extended or adjusted under 35 U.S.C. 154(b) by 1248 days.

(21) Appl. No.: 11/408,897

(22) Filed: Apr. 21, 2006

(65) Prior Publication Data

US 2007/0097067 A1 May 3, 2007

(30) Foreign Application Priority Data

Oct. 29, 2005 (KR) ..... 10-2005-0102668
Apr. 21, 2006 (KR) ..... 10-2006-0036066

(51) Int. Cl.
*G09G 3/36* (2006.01)

(52) U.S. Cl.
USPC ..... 345/102

(58) Field of Classification Search
USPC ..... 345/102
See application file for complete search history.

(56) References Cited

U.S. PATENT DOCUMENTS 6,445,168 B2 * 9/2002 Eisenhardt et al. ..... 323/284
2003/0175124 A1 * 9/2003 Hahn et al. ..... 417/44.1
2004/0012551 A1 * 1/2004 Ishii ..... 345/87

FOREIGN PATENT DOCUMENTS

JP 2001-134208 * 5/2001
JP 2002-203988 * 7/2002

OTHER PUBLICATIONS

Office Action issued in corresponding Chinese Patent Application No. 200610092233.4; issued May 9, 2008.

* cited by examiner

*Primary Examiner* — Dennis Joseph
(74) *Attorney, Agent, or Firm* — Brinks Gilson & Lione

(57) ABSTRACT

A backlight unit includes: an array unit, wherein the array unit comprises an input terminal, a first output terminal and an array coupled to the input terminal and coupled to the first output terminal, the array including a plurality of light emitting diodes; a switching unit coupled to the input terminal and coupled to the array; and a comparison unit coupled to the first output terminal and coupled to a control unit and operable to compare a reference current with an output current of the first output terminal; wherein the control unit controls the switching unit.

15 Claims, 5 Drawing Sheets

BACKLIGHT UNIT WITH FEEDBACK CIRCUIT AND DRIVING METHOD USING THE SAME

This application claims the benefit of Korean Patent Applications No. 2005-0102668 and No. 2006-0036066, filed in Korea on Oct. 29, 2005 and on Apr. 21, 2006, respectively, which is hereby incorporated by reference.

BACKGROUND OF THE INVENTION

1. Technical Field

This application relates to a backlight unit, more particularly, a backlight unit including a light emitting diode (LED) and a feedback circuit, and a method of driving the backlight unit.

2. Discussion of the Related Art

Flat panel display (FPD) devices that have a relatively light weight, a thin profile, and low power consumption characteristics are being developed and commonly used as a substitute for cathode ray tube (CRT) devices. Generally, display devices may be classified according to their ability for self-emission, and may include emissive display devices and non-emissive display devices. Emissive display devices display images by taking advantage of their ability to self-emit light, while the non-emissive display devices require a light source since they do not emit light by themselves. For example, plasma display panel (PDP) devices, field emission display (FED) devices, and electroluminescent display (ELD) devices are commonly used as emissive display devices. Liquid crystal display (LCD) devices may be categorized as non-emissive display devices commonly used in notebook and desktop computers because of their high resolution, capability of displaying colored images, and high quality image display.

An LCD module of the LCD devices includes an LCD panel for displaying images to an exterior and a backlight unit for supplying light to the LCD panel. The LCD panel includes two substrates facing and spaced apart from each other, and a liquid crystal material interposed therebetween. Liquid crystal molecules of the liquid crystal material have a dielectric constant and refractive index anisotropic characteristics due to their long, thin shape. In addition, two electric field generating electrodes are formed on the two substrates, respectively. Accordingly, an orientation alignment of the liquid crystal molecules can be controlled by supplying a voltage to the two electrodes, wherein transmittance of the LCD panel is changed according to polarization properties of the liquid crystal material. However, since the LCD panel is a non-emissive-type display device, an additional light source is required. Thus, a backlight unit is disposed under the LCD panel, wherein the LCD device displays images using light produced by the backlight unit. In general, backlight units may be classified into two types according to a disposition of the light source, such as side-type backlight unit and direct-type backlight unit. As display areas of the LCD devices become larger, direct-type backlight units including a plurality of light sources have become more commonly used in order to provide increased brightness.

Generally, discharge lamps, such as a cold cathode fluorescent lamps (CCFL) or external electrode fluorescent lamps (EEFL), are used as a light source of the backlight unit. Additionally, a light emitting diode (LED) may be used as the light source of the backlight unit.

FIG. 1 is an assembly view of a backlight unit including an LED of an LCD device according to the related art. In FIG. 1, an LCD device 1 includes a LCD panel 10 and a backlight unit 20 under the LCD panel 10. Here, the backlight unit 20 includes a plurality of printed circuit boards (PCB)s 22 arranged with a stripe type and a plurality of LEDs 24 in each PCB 22 where the LEDs 24 are arranged in series.

For example, the LEDs 24 displays white light by color-mixing through simultaneously lighting red, green and blue LEDs, which emit red, green and blue color light, respectively. LEDs 24 may be repeatedly arranged on the PCB 22 by a unit referred to as an array 26 which may include two to ten LEDs 24. The array 26 may be driven by a drive circuit.

FIG. 2 is a schematic circuit diagram of a backlight unit according to the related art. In FIG. 2, a backlight unit 1 includes an array unit 35 that includes an input terminal 32, an output terminal 34 and an array 30 including an LED 38. Further, the backlight unit 1 includes a switching unit 40 and a control unit 50 between the input terminal 32 and the array 30. The control unit 50 controls an operation of switching unit 40. The array 30 consists of a plurality of LEDs 38 that are connected to each other in series. A driving voltage "Vin" of array 30 is input at input terminal 32 and an output voltage "Vout" is output to the output terminal 34. The driving voltage "Vin" is applied to array 30 through the switching unit 40, such as a field effect transistor (FET). Control unit 50 controls the switching unit 40 through an external signal.

LEDs 38 have an inverse brightness change in accordance with their temperature. As the emission time of LED 38 increases, the temperature of LED 38 also increases. This increase in temperature reduces the brightness of LED 38.

FIG. 3 is a graphic of a brightness relationship between a junction temperature and brightness of an LED. As the temperature of an LED is increased, its brightness may be reduced. For example, when the temperature of a green LED is more than approximately 80 degrees Celsius (° C.), its brightness is reduced to approximately 80 percent (%). Further, when the temperature an LED is more than approximately 120 degrees Celsius (° C.), the LED may not be driven any more.

The longer the backlight unit is active the greater the temperature of the LEDs. The increased temperature leads to an increased reduction in the LEDs' output brightness, which results in image quality degradation. Therefore, there is a need for a backlight unit that senses and compensates for the degradation of LED brightness.

SUMMARY

A backlight unit can substantially reduce brightness reduction and compensate for brightness deviation in accordance with a temperature of an LED. A backlight unit includes an array unit including an input terminal, a first output terminal, and an array coupled between the input terminal and the first output terminal. The array includes a plurality of light emitting diodes (LED). A driving signal may be supplied to the input terminal. A switching unit coupled between the input terminal and the array may control the amount of the driving signal supplied to the array. Based on the output of the array, a comparison unit may provide feedback to a control unit. The control unit may provide a signal to the switching unit which changes the amount of the driving input signal to the array. A method that drives a backlight unit includes receiving an output current from an array of a plurality of light emitting diodes. The method compares the output current to a reference current, and changes a driving current input to the array of the plurality of light emitting diodes.

Other systems, methods, features and advantages of the invention will be, or will become apparent to one with skill in the art upon examination of the following figures and detailed description. It is intended that all such additional systems, methods, features, and advantages be included within this description, be within the scope of the invention, and be protected by the following claims.

Additional features and advantages of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the present invention, as embodied and broadly described herein, a backlight unit includes: an array unit, wherein the array unit comprises an input terminal, a first output terminal and an array coupled to the input terminal and coupled to the first output terminal, the array including a plurality of light emitting diodes; a switching unit coupled to the input terminal and coupled to the array; and a comparison unit coupled to the first output terminal and coupled to a control unit and operable to compare a reference current with an output current of the first output terminal; wherein the control unit controls the switching unit.

In another aspect of the invention, a method of driving a backlight unit includes: receiving an output current from an array of a plurality of light emitting diodes; comparing the output current to a reference current; and changing a driving current input to the array of the plurality of light emitting diodes.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION

Figure 1:
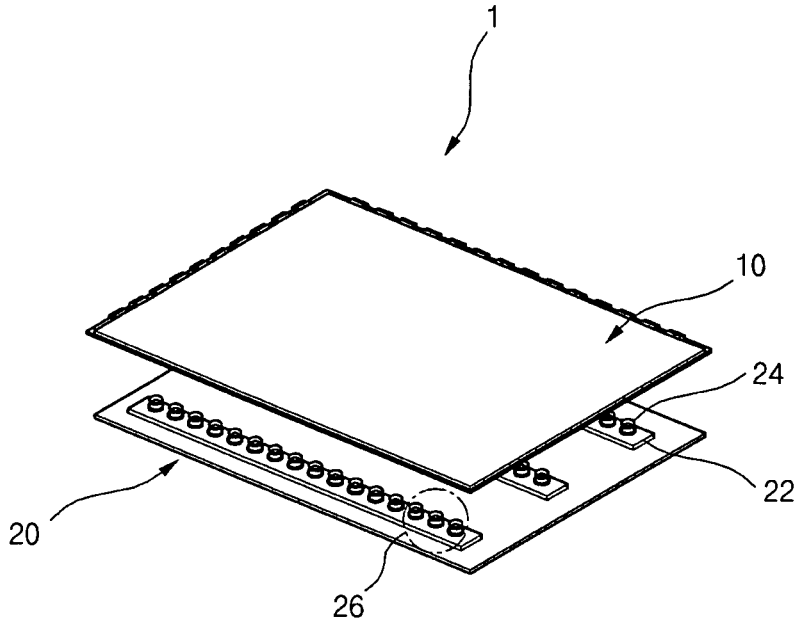
FIG. 1 RELATED ART
FIG. 1 is an assembly view of a backlight unit including an LED of an LCD device according to the related art.
Figure 2:
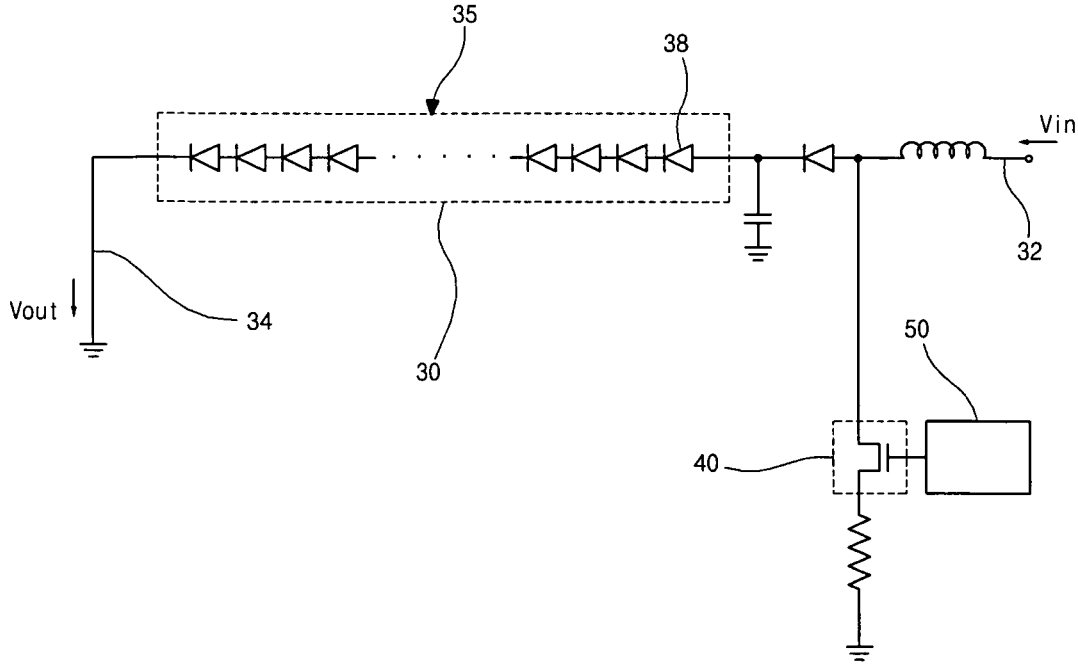
FIG. 2 RELATED ART
FIG. 2 is a schematic circuit diagram of a backlight unit according to the related art.
Figure 3:
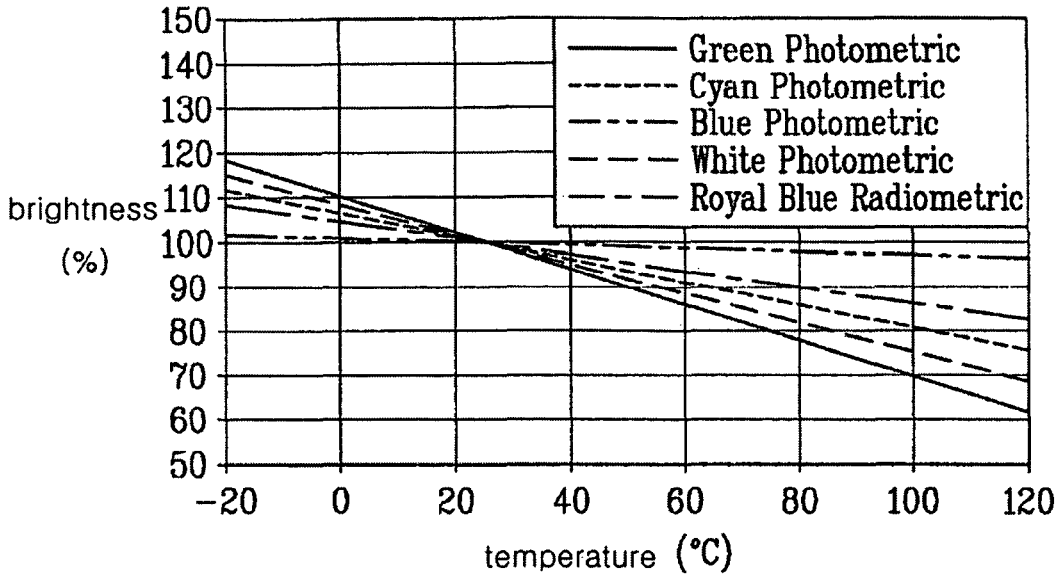
FIG. 3 is a graphic view of a brightness relationship between a junction temperature and brightness of an LED.
Figure 4:
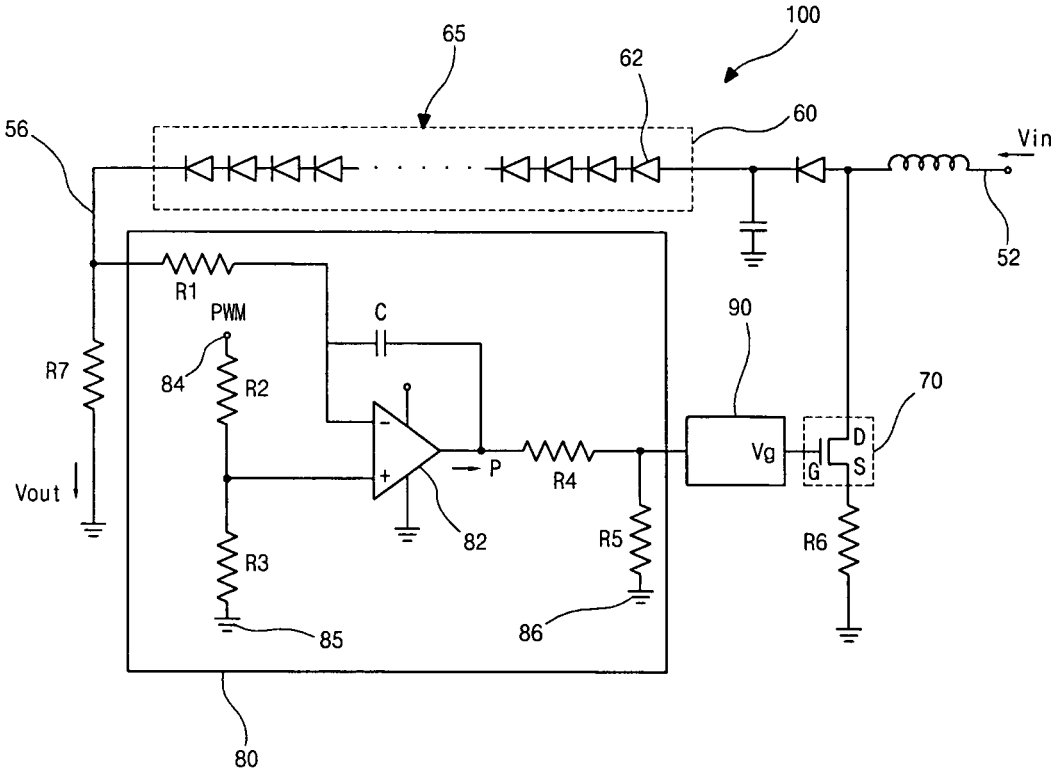
FIG. 4 is a schematic circuit diagram of a backlight unit including a feedback circuit according to the present invention.

FIG. 4 is a schematic circuit diagram of a backlight unit including a feedback circuit according to the present invention. In FIG. 4, a backlight unit 100 includes an array unit 65 including an input terminal 52, a first output terminal 56, and an array 60 between the input terminal 52 and the first output terminal 56. The array 60 includes a plurality of light emitting diodes (LED) 62 which are driving by a power source applied to input terminal 52.

The array 60 may include a plurality of LEDs 62 connected to each other in series. For example, array 60 may consist of red, green and blue LEDs or of red, green, blue, green and red LEDs in series. Further, the backlight unit 100 may include a printed circuit board (PCB) (not shown) under the array 60.

A driving signal, such as a voltage or current, may be applied through the input terminal 52. The driving voltage "Vin" may have a uniform width within a range that does not substantially damage to the LED 62 as a voltage more than "turn on" voltage.

Input terminal 52 may be coupled to a power source while first output terminal 56 may be grounded.

Switching unit 70 controls the driving voltage "Vin" applied to array 60, and accordingly also controls the driving current applied to array 60. A field effect transistor (FET) may be utilized as switching unit 70. For example, when the switching unit 70 is a negative (n) type FET, switching unit 70 includes a drain electrode "D" connected to input terminal 52, a source electrode "S" spaced apart from the drain electrode "D" and grounded, and a gate electrode "G" connected to control unit 90.

The driving voltage "Vin" applied to array 60 is turned ON/OFF by applying a control signal P, such as a gate voltage, from the control unit 90 to the gate electrode "G." The driving current can be controlled in accordance with the gate voltage. In other words, a width of the driving current applied to the array 60 may be controlled by modulating an operation of the switching unit 70 considering the control signal P.

Comparison unit 80 is coupled between first output terminal 56 and control unit 90. Comparison unit 80 compares a reference current generated by a pulse width modulation (PWM) signal and an output current detected from first output terminal 56. Comparison unit 80 may generate a feedback signal based on the comparison of the reference current and the detected output current. For example, when the output current is smaller than the reference current, comparison unit outputs a predetermined control signal P to the control unit 90.

Comparison unit 80 includes a comparator 82 such as an operational amplifier (OP-AMP). Comparator 82 includes an inverting terminal receiving the output current from array 60, a non-inverting terminal receiving the reference current, and a second output terminal that may output a control signal P determined through a comparison of the output current and the reference current.

The control unit 90 may control switching unit 70. When the control signal P is transmitted from comparison unit 80, the driving signal applied to array 60 may be changed. For example, a driving current may be increased by controlling the gate voltage of switching unit 70.

The brightness of backlight unit 100 is compensated using an output current of array 60. When the temperature of the LEDs 62 is increased, the brightness of the LEDs 62 is reduced. A reduction in the brightness of LEDs 62 reduces the output current detected at the first output terminal 56.

The backlight unit 100 analyzes the brightness of the LEDs 62 of array 60 by comparing the output current with a reference current. When the output current is compared with the reference current, through the comparison unit, no reduction in brightness is detected where the output current is greater than the reference current. Alternatively, when the output current is smaller than the reference current, a reduction in brightness is detected. This is one example of a configuration for comparator 82. Other configurations of comparator 82 may be used to detect a reduction in the brightness of LEDs 62.

When a reduction in brightness is detected, comparison unit 80 transmits the control signal P to control unit 90. Control unit 90 receives the control signal P and changes the gate voltage of switching unit 70 accordingly. For example, control unit 90 may increase the gate voltage of switching unit 70. Therefore, the driving current is changed so the brightness is increased and a uniform brightness is maintained. The control of the gate voltage occurs at a rate, such as real-time, thereby maintaining a uniform brightness for a viewer.

According to the backlight unit 100 and the driving method of the backlight unit 100 of the present disclosure, variation of the output current is reduced to less than 3 percent (%), changed to more than 25 percent (%) in accordance with a service temperature, more specifically, a deviation of the output current between the different arraies from each other of more than 20 percent (%) can be reduced to less than 5 percent (%).

Comparison unit 80 may include a first resistor "R1" between first output terminal 56 and the inversion terminal of comparator 82. A capacitor "C" may be coupled between the first resistor "R1" and the second output terminal of comparator 82. A second resistor "R2" may be coupled between a PWM terminal 84 receiving a PWM voltage and the non-inversion terminal of comparator 82. A third resistor "R3" may be coupled between the non-inversion terminal of comparator 82 and a first ground terminal 85. A fourth resistor "R4" may be coupled between the output terminal of comparator 82 and control unit 90. A fifth resistor "R5" may be coupled between the fourth resistor "R4" and control unit 90. A second ground terminal 86 may be connected to the fifth resistor "R5."

Backlight unit with a feedback circuit 100 may include a sixth resistor "R6" coupled to switching unit 70, and a seventh resistor "R7" coupled to the first resistor "R1" and coupled to the first output terminal 56. Here, the first output terminal 56 is grounded through the seventh resistor "R7."

Figure 5:
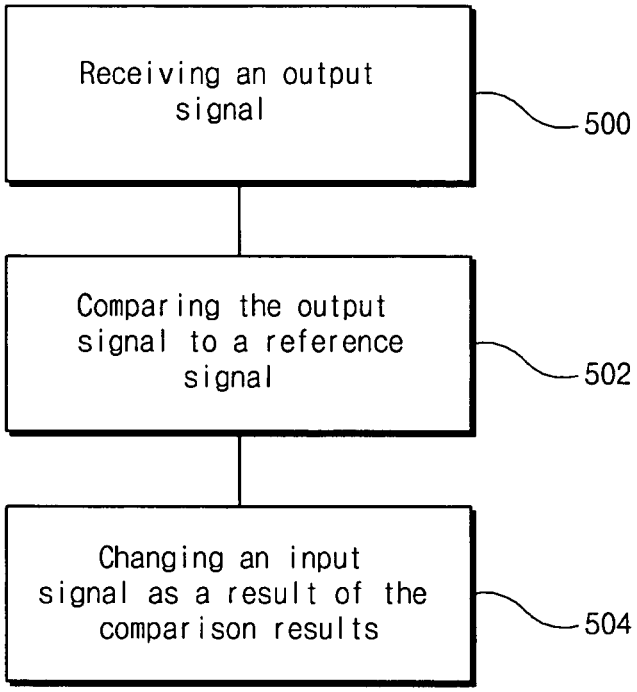
FIG. 5 is a flowchart of a process to drive a backlight unit including a feedback circuit according to the present invention.

FIG. 5 is a flowchart of a backlight unit including a feedback circuit according to the present invention. At act 500, the feedback circuit receives an output signal from an array comprising a plurality of LEDs. The output signal may be an output current. The output current may vary in relation to the temperature of one or more of the LEDs included within the array. At act 502, the feedback circuit compares the received output signal to a reference signal. The reference signal may be a reference current. The reference current may be generated by a pulse width modulating (PWM) circuit. A comparator, such as an OP-AMP, may be used to compare the output signal and the reference signal. The comparison of the output signal and the reference signal occurs in real-time. Where the comparison determines that the amplitude/magnitude of the output signal is less than the amplitude/magnitude of the reference signal, the feedback circuit transmits a control signal that causes the driving signal supplied to the array to be changed. At act 504, a switching unit receives a signal from a control unit and changes the amount of driving signal provided to the array. For example, the switching unit may increase a driving current supplied to the array.

According to the present invention, the array units may receive the same reference current as each other. In other words, one reference current may be utilized with respect to the array units so that variation between the array units does not generate. Therefore, the array units may receive the same static current as each other regardless of a property difference between the array units.

It will be apparent to those skilled in the art that various modifications and variations can be made in a liquid crystal display device of the present invention without departing from the spirit or scope of the invention. Thus, it is intended that the present invention cover the modifications and variations of this invention provided they come within the scope of the appended claims and their equivalents.

What is claimed is:

1. A backlight unit, comprising:

an array unit, wherein the array unit comprises an input terminal, a first output terminal and an array coupled to the input terminal and coupled to the first output terminal, the array including a plurality of light emitting diodes (LEDs);

a switching unit coupled to the input terminal and coupled to the array; and a comparison unit coupled to the first output terminal and coupled to a control unit and operable to compare a reference current with an output current of the first output terminal, wherein the comparison unit comprises a comparator, a pulse width modulation circuit, a first resistor and a capacitor, wherein the comparator includes an operational amplifier (OP-AMP), wherein the operational amplifier includes an inverting terminal receiving the output current, a non-inverting terminal receiving the reference current, and a second output terminal outputting the control signal by comparing the output current and the reference current, wherein the pulse width modulation circuit includes a PWM terminal receiving a PWM signal, a ground terminal, a second resistor coupled to the PWM terminal, a third resistor coupled to the ground terminal, and a node connecting to the second and third resistors, wherein the PWM terminal is directly connected to the second resistor, wherein the first resistor is coupled between the first output terminal of the array unit and the inverting terminal of the OP-AMP, wherein the capacitor is coupled between the inverting terminal of the OP-AMP and the second output terminal of the OP-AMP and is connected directly to each of the inverting terminal of the OP-AMP and the second output terminal of the OP-AMP, wherein the control unit controls the switching unit, wherein the node of the pulse width modulation circuit is directly connected to the non-inverting terminal of the operational amplifier, and wherein the reference current is generated by the pulse width modulation circuit and applied to the non-inverting terminal of the operational amplifier.

2. The backlight unit of claim 1, wherein the comparison unit is operable to generate a control signal when the output current of the array is different from the reference current.

3. The backlight unit of claim 2, wherein an array driving current is varied in response to the control signal.

4. The backlight unit of claim 1, wherein the switching unit comprises a field effect transistor.

5. The backlight unit of claim 4, wherein the field effect transistor further comprises:

a drain electrode connected to the input terminal;

a source electrode spaced apart from the drain electrode and grounded; and a gate electrode connected to the control unit.

6. The backlight unit of claim 5, wherein the control unit controls a gate voltage applied to the gate electrode.

7. The backlight unit of claim 1, wherein the array consists of red, green and blue LEDs.

8. The backlight unit of claim 1, wherein the array consists of red, green, blue, green and red LEDs in order.

9. The backlight unit of claim 1, further comprising a printed circuit board (PCB) under the array.

10. The backlight unit of claim 1, wherein the backlight unit is coupled to a liquid crystal display panel, where the liquid crystal display panel comprises a first substrate facing and spaced apart from a second substrate, and a liquid crystal layer disposed between the first substrate and the second substrate.

11. The backlight unit of claim 1, wherein the reference current is applied to the comparison unit.

12. A method of driving a backlight unit, comprising:

receiving an output current from an array of a plurality of light emitting diodes;

comparing the output current to a reference current by a comparison unit, wherein the comparison unit comprises a comparator, a pulse width modulation circuit, a first resistor and a capacitor, wherein the comparator includes an operational amplifier (OP-AMP), wherein the operational amplifier includes an inverting terminal receiving the output current, a non-inverting terminal receiving the reference current, and an output terminal outputting the control signal by comparing the output current and the reference current, wherein the pulse width modulation circuit includes a PWM terminal receiving a PWM signal, a ground terminal, a second resistor coupled to the PWM terminal, a third resistor coupled to the ground terminal, and a node connecting to the second and third resistors, wherein the PWM terminal is directly connected to the second resistor, wherein the first resistor is coupled between the first output terminal of the array unit and the inverting terminal of the OP-AMP, wherein the capacitor is coupled between the inverting terminal of the OP-AMP and the output terminal of the OP-AMP and is connected directly to each of the inverting terminal of the OP-AMP and the output terminal of the OP-AMP, wherein the node of the pulse width modulation circuit is directly connected to the non-inverting terminal of the operational amplifier, and wherein the reference current is generated by the pulse width modulation circuit and applied to the non-inverting terminal of the operational amplifier; and changing a driving current input to the array of the plurality of light emitting diodes.

13. The method of claim 12, wherein changing the driving current comprises changing when the output current is different from the reference current.

14. The method of claim 13, wherein changing the driving current comprises changing the driving current in real-time.

15. The method of claim 13, wherein changing the driving current comprises supplying the driving current input to the array of the plurality of light emitting diodes.

* * * * *